US008544385B2

(12) United States Patent
Schuler-Cossette et al.

(10) Patent No.: US 8,544,385 B2
(45) Date of Patent: Oct. 1, 2013

(54) PRINTING PRESS WITH DIFFERENT FIXED CUTOFFS AND METHOD

(75) Inventors: Laura Schuler-Cossette, Brentwood, NH (US); Wesley Clements, Durham, NH (US)

(73) Assignee: Goss International Americas, Inc., Durham, NH (US)

( * ) Notice: Subject to any disclaimer, the term of this patent is extended or adjusted under 35 U.S.C. 154(b) by 1376 days.

(21) Appl. No.: 12/152,596

(22) Filed: May 15, 2008

(65) Prior Publication Data

US 2009/0282996 A1 Nov. 19, 2009

(51) Int. Cl.
*B41F 13/02* (2006.01)

(52) U.S. Cl.
USPC ..... 101/220; 101/179; 101/180

(58) Field of Classification Search
USPC ..... 101/138, 180, 220, 221, 179
See application file for complete search history.

(56) References Cited

U.S. PATENT DOCUMENTS

| | | | | |
|---|---|---|---|---|
| 2,049,495 | A * | 8/1936 | Freuder | 101/119 |
| 4,864,927 | A | 9/1989 | Niehaus | |
| 5,353,703 | A | 10/1994 | Rieker | |
| 5,697,297 | A * | 12/1997 | Rasmussen | 101/219 |
| 5,868,071 | A | 2/1999 | Niemiro et al. | 101/218 |
| 5,950,536 | A | 9/1999 | Erbstein | 101/177 |
| 6,041,706 | A | 3/2000 | Murray | |
| 6,314,882 | B1 | 11/2001 | Peterson | |
| 7,032,515 | B2 | 4/2006 | Zimich et al. | 101/480 |
| 2002/0033105 | A1 | 3/2002 | Charette et al. | |

* cited by examiner

*Primary Examiner* — Ren Yan
*Assistant Examiner* — Allister Primo
(74) *Attorney, Agent, or Firm* — Davidson, Davidson & Kappel, LLC

(57) ABSTRACT

A web printing press is provided printing a web having a first side and a second side including a first plate cylinder having a first diameter for printing a first image on the first side of the web and a second plate cylinder having a second diameter different from the first diameter for printing a second image on the second side of the web. A method of printing a web is also provided.

16 Claims, 3 Drawing Sheets

PRINTING PRESS WITH DIFFERENT FIXED CUTOFFS AND METHOD

BACKGROUND

The present invention relates generally to printing presses and more particularly to printing presses with fixed cutoffs.

U.S. Pat. No. 5,868,071 discloses a variable cutoff printing press. The press includes a pair of plate cylinders and a pair of blanket cylinders with all of the cylinders having a cylindrical body and a central axis of rotation. The blanket cylinders are linearly adjustably positionable along the perpendicular to the adjustment axes to adjust the spacing between the plate and blanket cylinders to accommodate blanket sleeves of different thicknesses.

U.S. Pat. No. 5,950,536 discloses a press that has an impression plate mounted on the frame in the case of a non-perfecting press or an identical, mirror image assembly of plate and blanket cylinders in the case of a perfecting press. The plate cylinder sleeve is variable, whereby a length of an image to be printed is varied proportionally to the variable outer diameter while maintaining the outer diameter of the gapless blanket cylinder sleeve constant.

U.S. Pat. No. 7,032,515 discloses mounting a sub-frame on an existing frame of a printing press. New plate and blanket cylinders having different sizes than the plate and blanket cylinders used in the existing printing press may be mounted in the sub-frame to provide different printing lengths/cut offs.

BRIEF SUMMARY OF THE INVENTION

The present invention provides a web printing press printing a web having a first side and a second side including:

a first plate cylinder having a first diameter for printing a first image on the first side of the web; and a second plate cylinder having a second diameter different from the first diameter for printing a second image on the second side of the web.

The present invention also provides a method of printing a web including the steps of:

printing a first side of the web using a first plate cylinder having a first diameter; and printing a second side of the web using a second plate cylinder having a second diameter;

the first diameter being different from the second diameter.

BRIEF DESCRIPTION OF THE DRAWINGS

A preferred embodiment of the present invention will be elucidated with reference to the drawings, in which.

DETAILED DESCRIPTION OF PREFERRED EMBODIMENTS

The ability to print two cutoffs in a single print unit may be advantageous in non-perfecting printing applications where one side of a web is printed at a time. A printing press including a print unit having two print couples, a first print couple with a fixed cutoff and a second print couple with a different fixed cutoff allows a single print unit to print two different cutoffs.

Printing two different cutoffs on a single print unit also may be advantageous during printing applications wherein both sides of the web are printed at the same time. A printing press including a print unit having two print couples, a first print couple with a fixed cutoff and a second print couple with a different fixed cutoff allows a single print unit to print two different cutoffs. For proper registration, the length of the fixed cutoffs may be integer multiples of each other.

Figure 1:
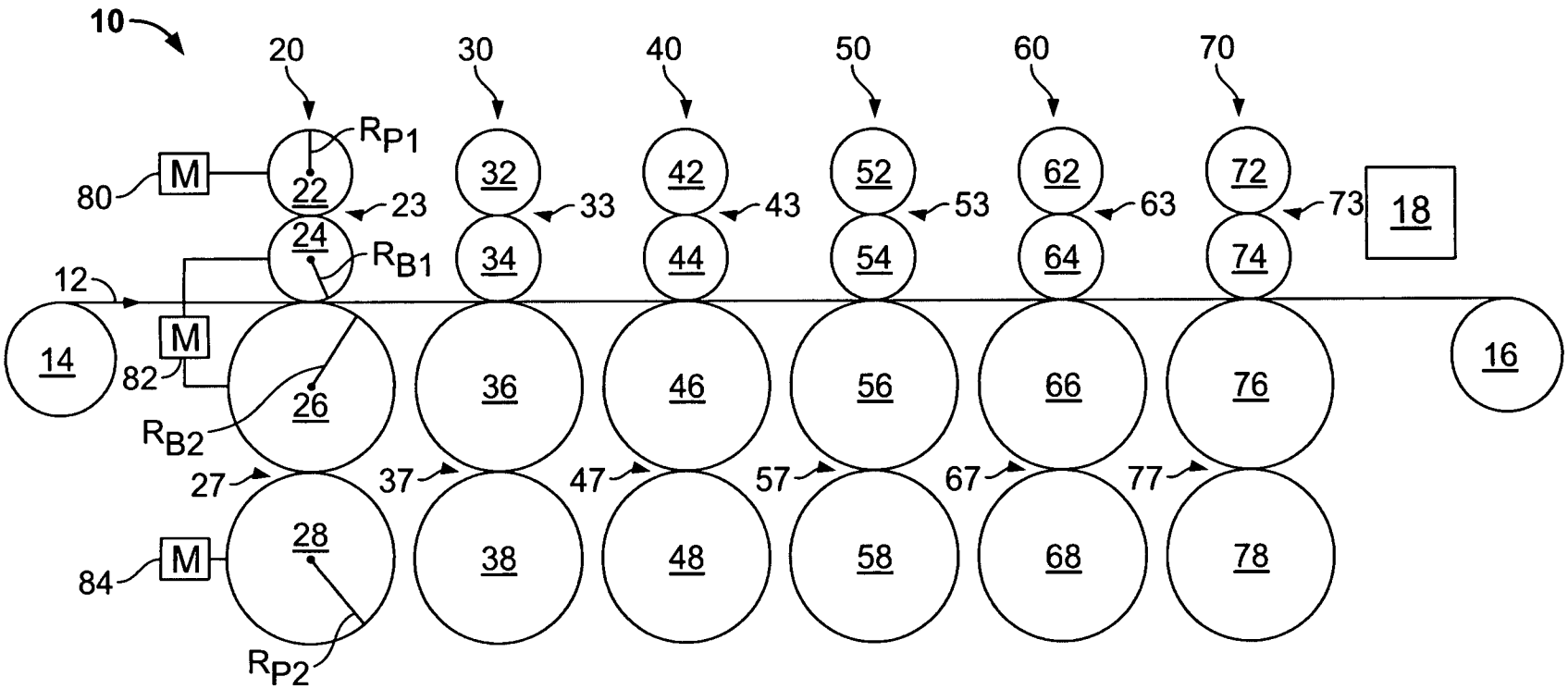
FIG. 1 shows a printing press in accordance with the present invention.

FIG. 1 shows a printing press 10 including six print units 20, 30, 40, 50, 60, 70. Each print unit prints a different color, for example, yellow, magenta, cyan, black, gold or silver, on web 12. Print unit 20 includes two print couples 23 and 27; one couple is located on either side of a web 12. Each print couple 23, 27 includes a plate cylinder 22, 28 and an associated blanket cylinder 24, 26. A radius $R_{P1}$ of plate cylinder 22 is, for example, 3.50 inches. A radius $R_{B1}$ of blanket cylinder 24 is, for example, 3.50 inches also. A radius $R_{P2}$ of plate cylinder 28 is, for example, 4.46 inches, and a radius $R_{B2}$ of blanket cylinder 26 is, for example, 4.46 inches also.

A motor 80 drives plate cylinder 22. A second motor 82 drives blanket cylinders 24 and 26. A third motor 84 drives plate cylinder 28. This motor arrangement allows selective contact between plate cylinders 22, 28 and blanket cylinders 24, 26 respectively, for example, for non-perfecting printing or for plate changing. Other motor arrangements, for example, motor arrangements in auto-transfer printing presses, are also preferred.

Printing units 30, 40, 50, 60 and 70 are arranged similarly to printing unit 20. Each printing unit 30, 40, 50, 60, 70 includes two print couples 33, 37, 43, 47, 53, 57, 63, 67, 73, 77. Each print couple 33, 37, 43, 47, 53, 57, 63, 67, 73, 77 includes one plate cylinder 32, 38, 42, 48, 52, 58, 62, 68, 72, 78 and an associated blanket cylinder 34, 36, 44, 46, 54, 56, 64, 66, 74, 76, respectively. Printing press 10 also includes a roll 14 and a windup roll 16. Web 12 travels from roll 14 to windup roll 16. After web 12 is printed by printing units 20, 30, 40, 50, 60, 70, web 12 is dried by a dryer 18. Windup roll 16 can then be removed and cut to a proper size, for example, for packaging material. Furthermore, the printed web may be delivered to another printing device, for example, a coater, a rewinder, a sheeter, a folder or other inline finishing device.

During a non-perfecting printing application where print couples 23, 33, 43, 53, 63 and 73 are printing on web 12, cutoff is 22 inches when radius $R_{P1}$ is 3.50 inches. During a non-perfecting printing application wherein print couples 27, 37, 47, 57, 67 and 77 are printing on web 12, cutoff is 28 inches when radius $R_{P2}$ is 4.46 inches. Thus, printing press 10 permits two different cutoffs, 22 inches and 28 inches, on web 12.

In a printing couple, it is preferable for the blanket cylinder to have a radius similar to the associated plate cylinder radius or an integer multiple thereof. For example, in printing couple 23 the radius $R_{P1}$ of plate cylinder 22 is 3.50 inches and the radius $R_{B1}$ of blanket cylinder 24 is 3.50 inches also.

Figure 2:
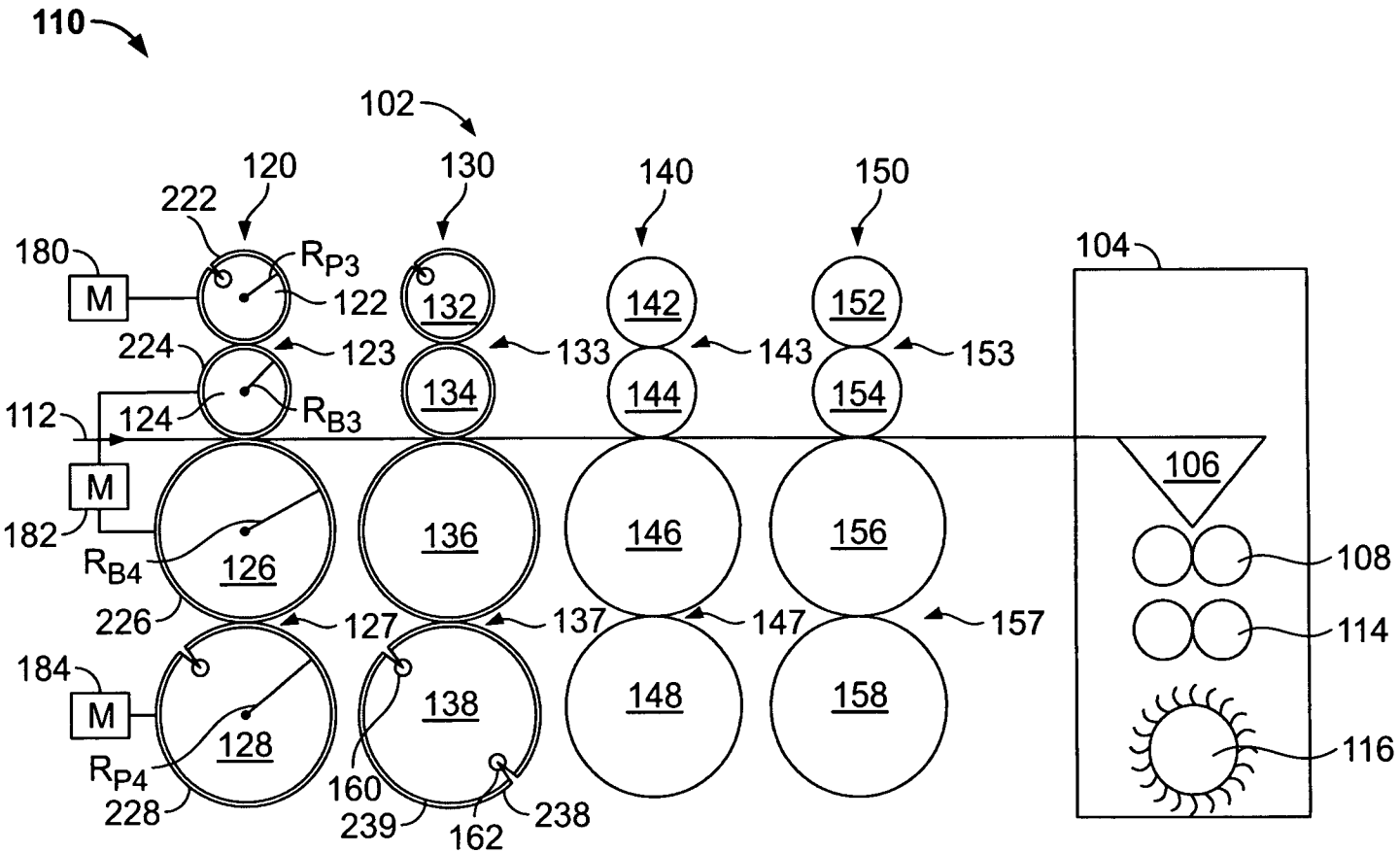
FIG. 2 shows a second embodiment of a printing press in accordance with the present invention.

A second embodiment of the present invention, printing press 110, is shown in FIG. 2. Printing press 110 is preferable when both sides of web 112 are printed at the same time. Printing press 110 includes a four color printing section 102. Printing section 102 includes four print units 120, 130, 140, 150. Each print unit 120, 130, 140, 150 prints a different color, for example, yellow, magenta, cyan or black, on web 112. Print unit 120 includes two print couples 123 and 127; one couple is located on either side of web 112. Each print couple 123, 127 includes a plate cylinder 122, 128 and an associated blanket cylinder 124, 126. A radius $R_{P3}$ of plate cylinder 122 is, for example, 3.50 inches. A radius $R_{B3}$ of blanket cylinder 124 is, for example, 3.50 inches also. A radius $R_{P4}$ of plate cylinder 128 is, for example, 7.00 inches, and a radius $R_{B4}$ of blanket cylinder 126 is, for example, 7.00 inches also.

Each plate cylinder and blanket cylinder may include printing plates and blankets respectively. As shown in printing unit 120, a printing plate 222 is mounted on an outer circumference of plate cylinder 122 and a printing plate 228 is mounted on an outer circumference of plate cylinder 128. A blanket 224 is mounted on blanket cylinder 124. A blanket 226 is mounted on blanket cylinder 126. Blankets 224, 226 may be gapless, axially removable blanket sleeves.

In another preferred embodiment shown in printing unit 130, plate cylinders may include multiple plate lock-up mechanisms carrying multiple printing plates. Plate cylinder 138 includes two plate lock-up mechanisms 160 and 162. Two printing plates 238 and 239 are mounted on plate cylinder 138. Printing plates 238 and 239 may carry a same image or different images. In a further preferred embodiment shown in printing unit 140, plate cylinders 142, 148 may be imaged directly and need not carry printing plates.

A motor 180 drives plate cylinder 122. A second motor 182 drives blanket cylinders 124 and 126. A third motor 184 drives plate cylinder 128. This motor arrangement allows selective contact between plate cylinders 122, 128 and blanket cylinders 124, 126, respectively, for example, for non-perfecting printing or for plate changing. Other motor arrangements, for example, motor arrangements in auto-transfer printing presses, are also preferred.

Printing units 130, 140 and 150 are arranged similarly to printing unit 120. Each printing unit 130, 140, 150 includes two print couples 133, 137, 143, 147, 153, 157. Each print couple 133, 137, 143, 147, 153, 157 includes one plate cylinder 132, 138, 142, 148, 152, 158 and an associated blanket cylinder 134, 136, 144, 146, 154, 156, respectively. Printing press 110 also includes a folder 104 including roll top of former 106, nip rollers 108, cutting cylinders 114 and a fan 116. Web 112 travels through printing section 102 and folder 104 where the web may be processed and folded into printed products.

During a printing application where both sides of web 112 are printed at the same time, the radius of printing plates 128, 138, 148 and 158 should be an integer multiple of the radius of printing plates 122, 132, 142 and 152. This relationship between radius $R_{P3}$ and radius $R_{P4}$ is needed to keep proper circumferential registration of images printed on web 112. For example, printing plate 122 has a radius $R_{P3}$ of 3.50 inches and a cutoff of 22 inches. Printing plate 128 has a radius $R_{P4}$ of 7.00 inches and a cutoff of 44 inches. Radius $R_{P4}$ of printing plate 128 is two times radius $R_{P3}$ of printing plate 122. Thus, two images are printed on web 112 by blanket cylinder 124 via plate cylinder 122 in the same length one image is printed on web 112 by blanket cylinder 126 via plate cylinder 128.

Figure 3:
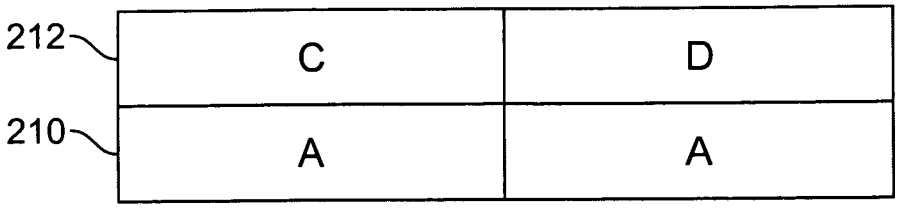
FIGS. 3, 4 and 5 show images printed on a web by the printing press shown in FIG. 2.
Figure 4:
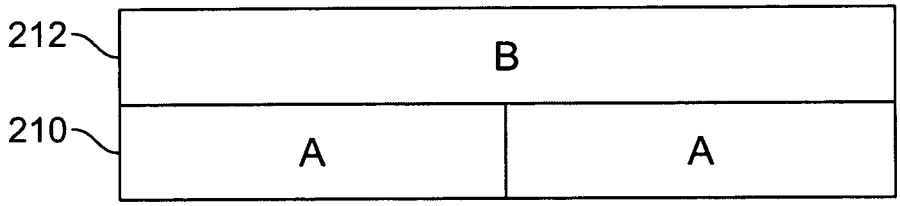
Figure 5:
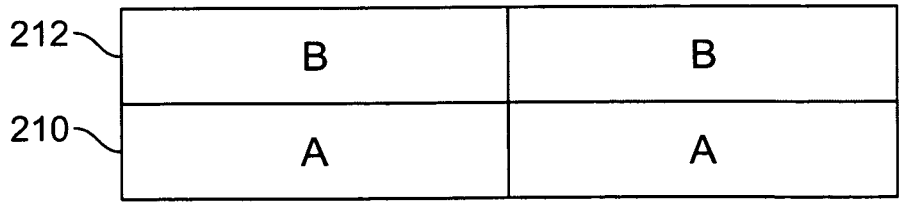

FIGS. 3, 4 and 5 show images printed on web 112. In FIG. 3, print couple 123 (FIG. 2) prints an image A on a top side 210 of web 112 while images C and D are printed on an underside 212 along the same length of web 112 by print couple 127 (FIG. 2). In this embodiment, two printing plates may be mounted around an outer circumference of plate cylinder 128 or one printing plate may be mounted which includes images C and D.

In FIG. 4, an image B is printed on the underside 212 of web 112, for example, by print couple 127, while print couple 123 (FIG. 2) prints two image A images on the top side 210 along the same length of web 112. If the diameters for plate cylinders 122 and 128 are non-integer multiples, a position of an image on one side could vary relative to a position of an image on the other side. In order to maintain proper circumferential registration during dual-sided printing, the diameters for plate cylinders 122 and 128 having images A and B and images A, C and D should be integer multiples of one another. Thus, the resultant printed web will have multiple repeat images on one side of web 112 and a full print length on the other side of web 112.

FIG. 5 shows two image B images printed on the underside 212 of web 112, for example by print couple 127, while print couple 123 (FIG. 2) prints two image A images on the top side 210 along the same length of web 112. Thus, printing press 110 also may be used to print web 112 conventionally, for example, an image A on the top side 210 corresponding to an image B on the underside 212 and this being repeated along web 112.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A web printing press printing a web having a first side and a second side comprising:

a first plate cylinder having a first diameter for printing a first image on the first side of the web; and a second plate cylinder having a second diameter different from the first diameter for printing a second image on the second side of the web;

a first blanket cylinder contacting the first plate cylinder and a second blanket cylinder contacting the second plate cylinder;

said first blanket cylinder and said second blanket cylinder forming a nip, and the web being printed while passing between the first blanket cylinder and the second blanket cylinder.

2. The web printing press as recited in claim 1 wherein the second diameter is an integer multiple of the first diameter.

3. The web printing press as recited in claim 1 wherein the second diameter is a non-integer multiple of the first diameter.

4. The web printing press as recited in claim 1 further comprising at least one motor for driving at least one of the first and second plate cylinders.

5. The web printing press as recited in claim 4 wherein the at least one motor includes a first motor driving the first plate cylinder, a second motor driving the first and second blanket cylinders and a third motor driving the second plate cylinder.

6. The web printing press as recited in claim 1 wherein a blanket is mounted on an outer circumference of the first or second blanket cylinder.

7. The web printing press as recited in claim 1 wherein at least one printing plate is mounted on an outer circumference of the first or second plate cylinder.

8. The web printing press as recited in claim 1 further comprising a third plate cylinder having the first diameter and a fourth plate cylinder having the second diameter, the third plate cylinder for printing the first side of the web downstream from the first plate cylinder, and the fourth plate cylinder for printing the second side of the web downstream from the second plate cylinder.

9. The web printing press as recited in claim 8 wherein the first plate cylinder prints a first color and the third plate cylinder prints a second color.

10. The web printing press as recited in claim 9 wherein the second plate cylinder prints the first color and the fourth plate cylinder prints the second color.

11. A method of printing a web comprising the steps of:

printing a first side of the web using a first plate cylinder having a first diameter;

printing a second side of the web using a second plate cylinder having a second diameter;

the first diameter being different from the second diameter;

providing a first blanket cylinder contacting the first plate cylinder and a second blanket cylinder contacting the second plate cylinder;

said first blanket cylinder and said second blanket cylinder forming a nip, and the web being printed while passing between the first blanket cylinder and the second blanket cylinder.

12. The method of printing a web as recited in claim 11 wherein the second diameter is an integer multiple of the first diameter.

13. The method of printing a web as recited in claim 11 wherein the second diameter is a non-integer multiple of the first diameter.

14. The method of printing a web as recited in claim 11 further comprising the steps of printing the first side of the web using a third plate cylinder having the first diameter downstream of the first plate cylinder and printing a second side of the web using a fourth plate cylinder having the second diameter downstream of the second plate cylinder.

15. The method of printing a web as recited in claim 14 wherein the first plate cylinder prints a first color on the first side of the web and the third plate cylinder prints a second color on the first side of the web.

16. The method of printing a web as recited in claim 15 wherein the second plate cylinder prints the first color on the second side of the web and the fourth plate cylinder prints the second color on the second side of the web.

* * * * *